US009304431B2

(12) United States Patent
Hayashi

(10) Patent No.: US 9,304,431 B2
(45) Date of Patent: Apr. 5, 2016

(54) IMAGE FORMING APPARATUS AND LIGHT CONCENTRATING DEVICE

(71) Applicant: KYOCERA Document Solutions Inc., Osaka (JP)

(72) Inventor: Kenichi Hayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/319,258

(22) Filed: Jun. 30, 2014

(65) Prior Publication Data

US 2015/0023696 A1 Jan. 22, 2015

(30) Foreign Application Priority Data

Jul. 17, 2013 (JP) ..... 2013-148309

(51) Int. Cl.

| | |
|---|---|
| ***G03G 21/08*** | (2006.01) |
| ***G03G 15/047*** | (2006.01) |
| ***G03G 15/04*** | (2006.01) |
| ***G03G 15/00*** | (2006.01) |

(Continued)

(52) U.S. Cl.

CPC ..... *G03G 15/047* (2013.01); *G03G 15/04036* (2013.01); *G03G 15/6532* (2013.01); *G03G 21/0005* (2013.01); *G03G 21/08* (2013.01); *G03G 15/169* (2013.01); *G03G 21/00* (2013.01); *G03G 21/0094* (2013.01); *G03G 21/06* (2013.01)

(58) Field of Classification Search

CPC ..... G03G 21/08
USPC ..... 399/128
See application file for complete search history.

(56) References Cited

U.S. PATENT DOCUMENTS 3,770,429 A * 11/1973 Kinoshita et al. ..... 430/119.71
3,778,148 A * 12/1973 Fujitsuka et al. ..... 399/190

(Continued)

FOREIGN PATENT DOCUMENTS

| | | | |
|---|---|---|---|
| JP | H01-88970 | U | 6/1989 |
| JP | H06-186801 | A | 7/1994 |
| JP | 2008-176246 | A | 7/2008 |

OTHER PUBLICATIONS

An Office Action; "Notice of Reasons for Rejection," issued by the Japanese Patent Office on Oct. 20, 2015 which corresponds to Japanese Patent Application No. 2013-148309 and is related to U.S. Appl. No. 14/319,258.

*Primary Examiner* — Clayton E Laballe
*Assistant Examiner* — Kevin Butler
(74) *Attorney, Agent, or Firm* — Studebaker & Brackett PC

(57) ABSTRACT

An image forming apparatus includes an image carrier, a development device, a transferring device, a static eliminating device, a cleaning device, a light concentrating member and a separating claw. On the image carrier, an electrostatic latent image is formed. The development device develops and visualizes the electrostatic latent image by a toner. The transferring device transfers the toner on the image carrier to a recording sheet. The static eliminating device irradiates the image carrier with a light to eliminate a remained static charge. The cleaning device removes the toner remained on the image carrier. The light concentrating member is arranged between the static eliminating device and image carrier to concentrate the light emitted from the static eliminating device and to irradiate the image carrier with the concentrated light. The separating claw is supported by the light concentrating member to separate the recording sheet from the image carrier.

7 Claims, 5 Drawing Sheets

(51) Int. Cl.

| | |
|---|---|
| *G03G 21/00* | (2006.01) |
| *G03G 15/16* | (2006.01) |
| *G03G 21/06* | (2006.01) |

(56) References Cited

U.S. PATENT DOCUMENTS

| | | | | | |
|---|---|---|---|---|---|
| 4,561,761 | A | * | 12/1985 | Fox | 399/187 |
| 4,695,152 | A | * | 9/1987 | Urso, Jr. | 399/187 |
| 4,947,216 | A | * | 8/1990 | Surti | 399/129 |
| 5,272,504 | A | * | 12/1993 | Omura et al. | 399/44 |
| 5,576,809 | A | * | 11/1996 | Yazawa et al. | 399/171 |
| 2002/0172530 | A1 | * | 11/2002 | Kido et al. | 399/128 |
| 2006/0198659 | A1 | * | 9/2006 | Niimi | 399/128 |
| 2008/0145117 | A1 | | 6/2008 | Takiguchi et al. | |
| 2009/0087219 | A1 | * | 4/2009 | Aoshima et al. | 399/128 |
| 2010/0158570 | A1 | * | 6/2010 | Kim et al. | 399/168 |
| 2011/0096452 | A1 | * | 4/2011 | Miyaji | 361/212 |
| 2011/0206416 | A1 | * | 8/2011 | Berg | 399/237 |
| 2011/0243609 | A1 | * | 10/2011 | Takami et al. | 399/128 |
| 2011/0299866 | A1 | * | 12/2011 | Kadota et al. | 399/50 |
| 2012/0027451 | A1 | * | 2/2012 | Shin | 399/98 |
| 2012/0224880 | A1 | * | 9/2012 | Sato et al. | 399/99 |
| 2013/0136499 | A1 | * | 5/2013 | Kamiyama | 399/128 |
| 2013/0195488 | A1 | * | 8/2013 | Hatano | 399/66 |
| 2013/0315626 | A1 | * | 11/2013 | Nakai et al. | 399/128 |
| 2014/0029964 | A1 | * | 1/2014 | Shibuya | 399/44 |
| 2015/0023696 | A1 | * | 1/2015 | Hayashi | 399/128 |
| 2015/0030351 | A1 | * | 1/2015 | Wakayama | 399/128 |
| 2015/0030352 | A1 | * | 1/2015 | Hayashi | 399/128 |

* cited by examiner

IMAGE FORMING APPARATUS AND LIGHT CONCENTRATING DEVICE

INCORPORATION BY REFERENCE

This application is based on and claims the benefit of priority from Japanese Patent application No. 2013-148309 filed on Jul. 17, 2013, the entire contents of which are incorporated herein by reference.

BACKGROUND

The present disclosure relates to an image forming apparatus including an static eliminating device eliminating a static charge remained on a surface of a photosensitive drum and a separating claw separating a recording sheet with a transferred toner from the photosensitive drum, and a light concentrating device arranged between the photosensitive drum and static eliminating device.

In a general manner of forming an image, a surface of a photosensitive drum is electrically charged to a predetermined electrical potential by a charging device and an electrostatic latent image according to image data is formed on the surface by photographic exposure. The electrostatic latent image is developed with a toner (a developer) by a development device, and then, transferred on a recording sheet by a transferring device. The toner remained on the surface of the photosensitive drum is removed by a cleaning device and a static charge remained on the photosensitive drum is eliminated by a static eliminating device. In the photosensitive drum, a cycle having such electrical charging, photographic exposure and static elimination is repeated in the image forming.

In the transferring device, voltage with an opposite polarity to the toner is applied onto an opposite face to a face having the transferred toner in the recording sheet and the toner is transferred onto the recording sheet from the photosensitive drum. At this time, the recording sheet may be electrically charged and electrostatically attracted to the photosensitive drum. Such a disposition is remarkably occurred particularly in a thin recording sheet. In response, there is an image forming apparatus including a separating claw coming into contact with the photosensitive drum in a counter direction to a rotating direction of the photosensitive drum. The separating claw forcedly separates a leading edge of the recording sheet from the photosensitive drum.

Further, the image forming apparatus may include a conveyance auxiliary member at a downstream side from the separating claw in a conveying direction of the recording sheet. The conveyance auxiliary member is configured to guide the recording sheet so as to prevent an unfixed toner from contacting with components and others in the periphery of a conveying path of the recording sheet due to flotation of recording sheet after the recording sheet is separated by the separating claw. In the conveying path of the recording sheet, it is necessary to provide a space with a certain degree of a height above a toner transferred face of the recording sheet.

Meanwhile, according to space saving, miniaturization of the photosensitive drum and acceleration of the image forming apparatus are progressed, and accordingly, a time from the static elimination of the photosensitive drum to the electrical charging in a next cycle is shortened. Therefore, it is necessary to consider an exposure memory of the photosensitive drum. The exposure memory is a phenomenon in which, between an exposed area and an unexposed area in the photosensitive drum after the static elimination, surface electrical potentials are different from each other, and then, the surface of photosensitive drum is electrically charged unevenly in the electrical charging in the next cycle. Due to this phenomenon, a defective image called as a ghost may be occurred. A problem of the exposure memory is feared particularly in an amorphous silicon photoreceptor. As a countermeasure to this problem, it is necessary to provide an interval between the static eliminating device and charging device as wider as possible and to secure a time sufficiently attenuating the surface electrical potential of the photosensitive drum before the electrical charging in the next cycle. Therefore, it is necessary to position the static eliminating device at an upstream side from the cleaning device in the rotating direction of the photosensitive drum.

However, the separating claw and conveyance auxiliary member must be positioned at the upstream side from the cleaning device in the rotating direction of the photosensitive drum. Therefore, if the interval between the static eliminating device and charging device is provided wider in order to solve the exposure memory, and moreover, the separating claw and conveyance auxiliary member are provided, it is necessary to arrange the static eliminating device, separating claw and conveyance auxiliary member between the transferring device and cleaning device. Further, between the transferring device and cleaning device, it is necessary to provide another space protecting the toner transferred face of the recording sheet. If the photosensitive drum is miniaturized, the space between the transferring device and cleaning device becomes narrower.

SUMMARY

In accordance with an embodiment of the present disclosure, an image forming apparatus includes an image carrier, a development device, a transferring device, a static eliminating device, a cleaning device, a light concentrating member and a separating claw. On the image carrier, an electrostatic latent image is formed. The development device develops and visualizes the electrostatic latent image by a toner. The transferring device transfers the toner on the image carrier to a recording sheet. The static eliminating device irradiates the image carrier with a light to eliminate a remained static charge. The cleaning device removes the toner remained on the image carrier. The light concentrating member is arranged between the static eliminating device and image carrier to concentrate the light emitted from the static eliminating device and to irradiate the image carrier with the concentrated light. The separating claw is supported by the light concentrating member to separate the recording sheet from the image carrier.

In accordance with an embodiment of the present disclosure, a light concentrating device is arranged between an image carrier and a static eliminating device. On the image carrier, a toner image is formed. The static eliminating device eliminates a remained static charge on the image carrier after the toner image is transferred on a recording sheet. The light concentrating device includes a light concentrating body, a separating claw and a conveyance auxiliary member. The light concentrating body concentrates a light emitted from the static eliminating device and irradiates the image carrier with the concentrated light. The separating claw is supported by the light concentrating body to separate the recording sheet from the image carrier. The conveyance auxiliary member is supported by the light concentrating body to guide the recording sheet so as to prevent the toner image from contacting with components in the periphery of a conveying path of the recording sheet.

The above and other objects, features, and advantages of the present disclosure will become more apparent from the following description.

DETAILED DESCRIPTION

Figure 1:
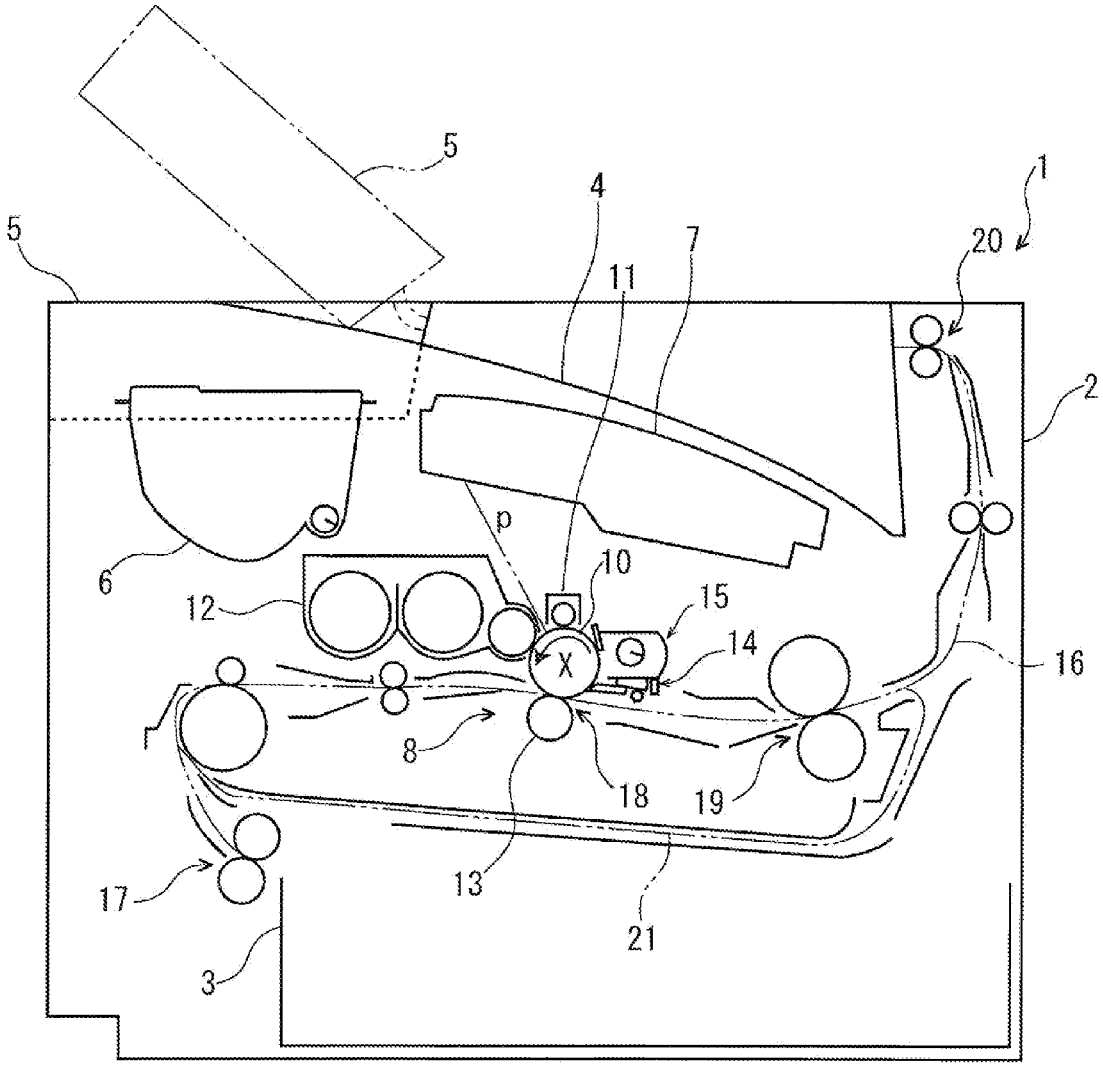
FIG. 1 is a schematic diagram schematically showing a printer according to an embodiment of the present disclosure.
Figure 2:
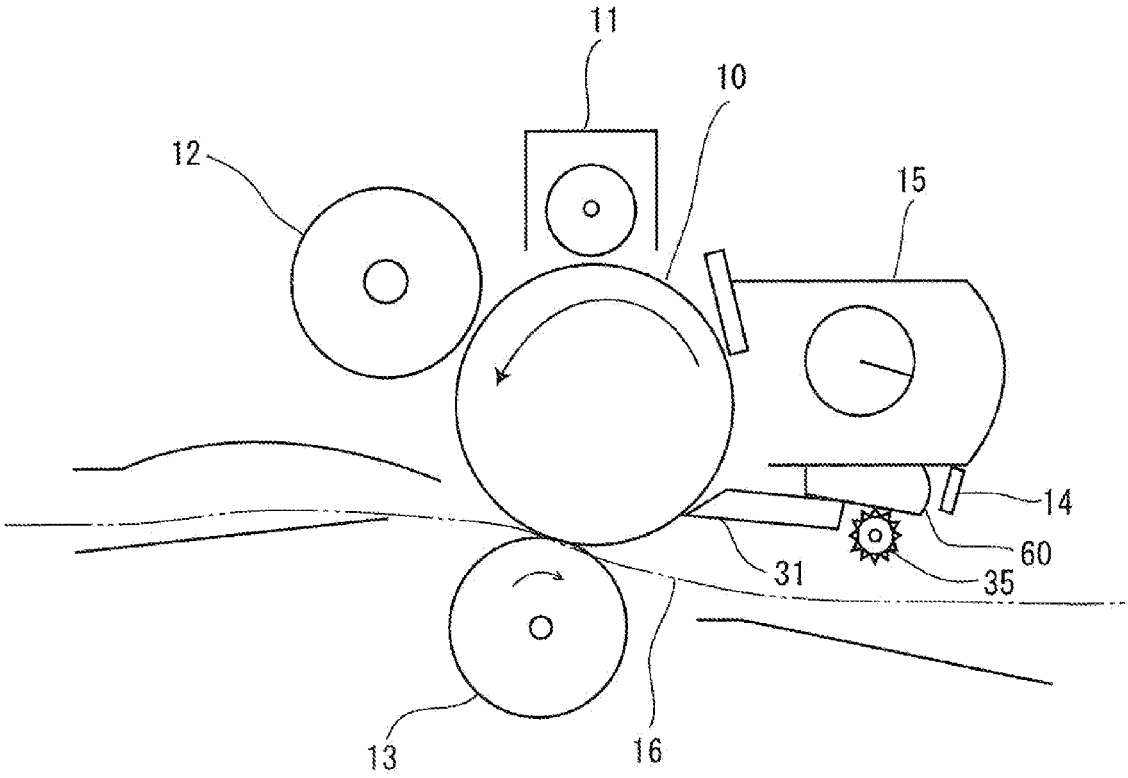
FIG. 2 is a schematic view schematically showing a structure of a photosensitive drum and its periphery in the printer according to the embodiment of the present disclosure.

First, with reference to FIGS. 1 and 2, the entire structure of a printer 1 as an electrographic image forming apparatus will be described. FIG. 1 is a schematic diagram schematically showing a printer according to an embodiment of the present disclosure. FIG. 2 is a schematic view schematically showing a structure of a photosensitive drum and its periphery in the printer according to the embodiment of the present disclosure. Hereinafter, it will be described so that the front side of the printer 1 is positioned at the right-hand side of FIG. 1. Left and right directions in FIG. 1 will be described on the basis of a direction when the printer 1 is viewed from the front side.

As shown in FIG. 1, the printer 1 includes a box-like formed printer main body 2. In a lower part of the printer main body 2, a sheet feeding cartridge 3 storing recording sheets (not shown) is installed and, in a top face of the printer main body 2, a sheet ejected tray 4 is formed. To a top face of the printer main body 2, an upper cover 5 is openably/closably attached at the front side of the sheet ejected tray 4. Below the upper cover 5, a toner container 6 as a toner case containing a toner is installed.

In an upper part of the printer main body 2, an exposure device 7 is located below the sheet ejected tray 4. Below the exposure device 7, an image forming part 8 is arranged. In the image forming part 8, a photosensitive drum 10 as an image carrier is rotatably arranged. Around the photosensitive drum 10, a charging device 11, a development device 12 as an attachment member, a transfer roller 13, a static eliminating device 14 and a cleaning device 15 are located in order along a rotating direction (refer to an arrow X in FIG. 1) of the photosensitive drum 10.

Inside the printer main body 2, a conveying path 16 for the recording sheet is arranged. At an upstream end in the conveying path 16, a sheet feeder 17 is positioned. At an intermediate stream part in the conveying path 16, a transferring part 18 composed of the photosensitive drum 10 and transfer roller 13 is positioned. At a downstream part in the conveying path 16, a fixing device 19 is positioned. At a downstream end in the conveying path 16, a sheet ejecting part 20 is positioned. Below the conveying path 16, an inversion path 21 for duplex printing is arranged.

As shown in FIG. 2, between the transferring roller 13 and static eliminating device 14, separating claw 31 and conveyance auxiliary member 35 are arranged and supported by a light concentrating member 60.

When the power is supplied to the printer 1, initial determination, such as temperature determination of the fixing device 19, is carried out. Subsequently, in the printer 1, when a printing start is directed, image forming operation is carried out as follows.

First, the surface of the photosensitive drum 10 is electric-charged by the charging device 11. Then, photographic exposure corresponding to image data on the photosensitive drum 10 is carried out by a laser light (refer to a two-dot chain line p in FIG. 1) from the exposure device 7, thereby forming an electrostatic latent image on the surface of the photosensitive drum 10. Subsequently, the development device 12 develops (visualizes) the electrostatic latent image to a toner image by a toner (a developer).

On the other hand, the recording sheet fed from the sheet feeding cartridge 3 by the sheet feeder 17 is conveyed to the transferring part 18 in a suitable timing for the above-mentioned image forming operation, and then, the toner image on the photosensitive drum 10 is transferred onto the recording sheet in the transferring part 18. The recording sheet with the transferred toner image is separated from the surface of the photosensitive drum 10 by the separating claw 31 (refer to FIG. 2), pressed by the conveyance auxiliary member 35 (refer to FIG. 2) so as not to float, and conveyed to a downstream side in the conveying path 16. Subsequently, the recording sheet goes into the fixing device 19, and then, the toner image is fixed on the recording sheet in the fixing device 19. The recording sheet with the fixed toner image is ejected from the sheet ejecting part 20 to the sheet ejected tray 4. An electrical potential remained on the photosensitive drum 10 is eliminated by the static eliminating device 14. The toner remained on the photosensitive drum 10 is collected by the cleaning device 15.

Figure 3:
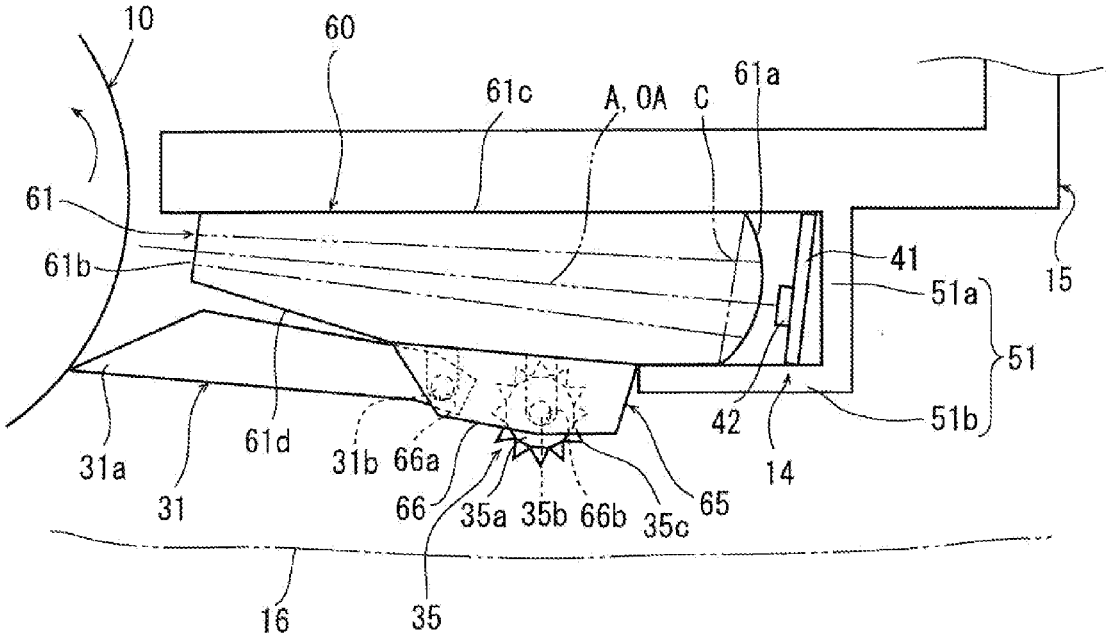
FIG. 3 is a side view showing a static eliminating device, a separating claw, a conveyance auxiliary member and a light concentrating member in the printer according to the embodiment of the present disclosure.
Figure 4:
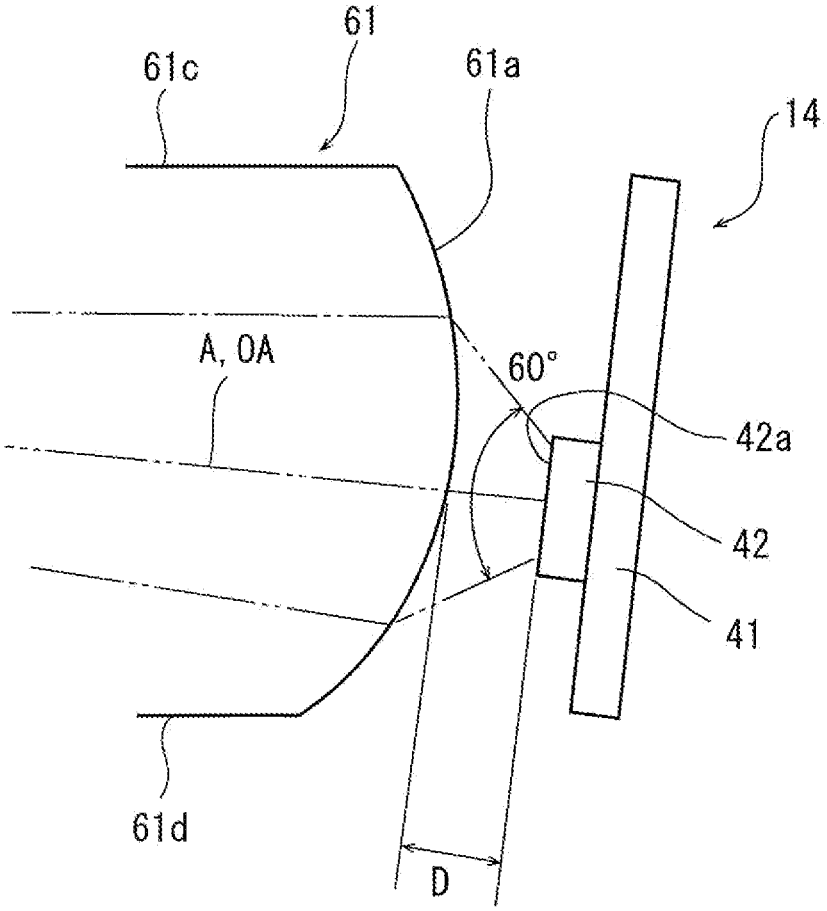
FIG. 4 is an enlarged side view showing the static eliminating device and an incident face of the light concentrating member in the printer according to the embodiment of the present disclosure.

Next, with reference to FIGS. 3 and 4, the static Eliminating device 14, separating claw 31, conveyance auxiliary member 35 and light concentrating member 60 will be described. FIG. 3 is a side view showing the static eliminating device, separating claw, conveyance auxiliary member and light concentrating member. FIG. 4 is an enlarged side view showing the static eliminating device and incident face of the light concentrating member.

Figure 5:
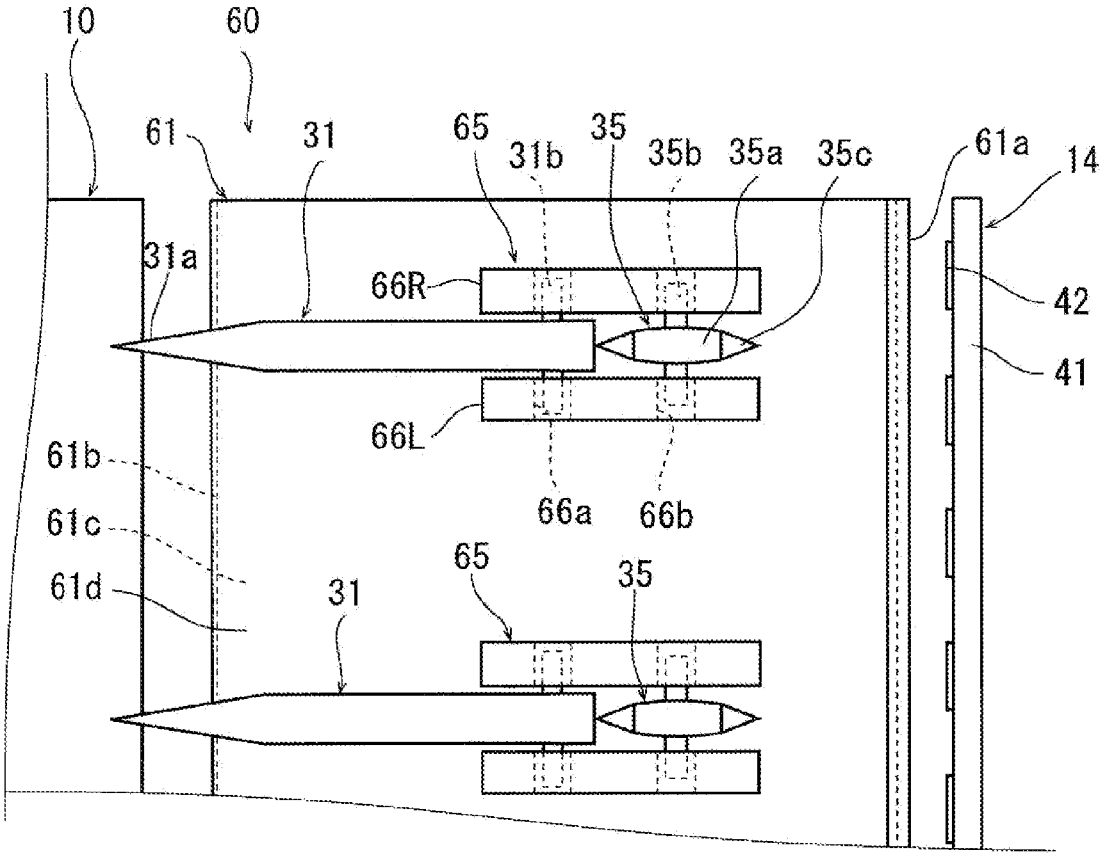
FIG. 5 is a bottom view showing the static eliminating device, separating claws, conveyance auxiliary members and light concentrating member in the printer according to the embodiment of the present disclosure.

The static eliminating device 14 is configured so that a plurality of light emitting diode (LED) tips 42 as a light source are arranged in a line in an axial direction on an elongated substrate 41 (refer to FIG. 5). A length of the substrate 41 is roughly similar to a length in the axial direction of the photosensitive drum 10. As the LED tip 42, the tip emitting a light with a wavelength of 650 nm, a light amount of 4.0 $\mu J/cm^2$ and a maximum irradiation angle of 60 degrees may be used.

The static eliminating device 14 is supported by a supporting part 51 formed in the cleaning device 15. The supporting part 51 is formed in an outside face at the upstream side in the rotating direction of the photosensitive drum 10 in the cleaning device 15 so as to extend in the axial direction of the photosensitive drum 10. The supporting part 51 has an L-shaped section, and then, has a base part 51*a* extending downward from a lower face of the cleaning device 15 and a leading part 51*b* extending from a leading end of the base part 51*a* toward the photosensitive drum 10. The static eliminating device 14 has a slightly upward inclined posture so that a center axis (an optical axis) A of the LED tip 42 is positioned roughly perpendicular to the surface of the photosensitive drum 10.

The separating claw 31 is a bar like member having a rectangular section. A leading end part 31*a* of the separating claw 31 is formed in a tapered claw like shape in a side view and a plan view. In left and right side faces of a base end side of the separating claw 31, rotation shafts 31*b* respectively extending in the left and right directions are formed.

The conveyance auxiliary member 35 is a disk like member having a disk part 35*a* and a rotation shaft 35*b* extending in the left and right directions from the center of the disk part 35*a*. On an external circumference face of the disk part 35*a*, a plurality of projected parts 35*c* having respective acute top portions are formed radially.

The light concentrating member 60 (a light concentrating device) includes a light concentrating body 61 concentrating a static elimination light and a supporting member 65 supporting the separating claw 31 and conveyance auxiliary member 35. The light concentrating body 61 is a plate like member having a rectangular plan shape. The light concentrating body 61 is arranged between the static eliminating device 14 and photosensitive drum 10 and attached to the cleaning device 15. A length in the left and right directions of the light concentrating body 61 is similar to the length in the axial direction of the photosensitive drum 10. A length in forward and backward directions of the light concentrating body 61 is shorter than an interval between the static eliminating device 14 and photosensitive drum 10. The light concentrating body 61 is made of a material having a high transparency with respect to a light having a wavelength (650 nm) of the LED tip 42. As such a material, a resin, such as polycarbonate or acryl resin, may be used. The transparency of polycarbonate resin with respect to the light having the wavelength of 650 nm is approximately 85% and the transparency of acryl resin with respect to the light having the wavelength of 650 nm is approximately 90%. It is preferable that the light concentrating body 61 has the transparency with respect to the static elimination light of 80% or more.

A face 61*a* at the static eliminating device 14's side of the light concentrating body 61 is corresponding to an incident face for the static elimination light emitted by the static eliminating device 14. The incident face 61*a* is formed in a convex lens like shape projected toward the LED tip 42 in a side view. As shown in FIG. 4 and others, the center of the incident face 61*a* is positioned just on the optical axis A and a tangent line to the incident face 61*a* passing through the center of the incident face 61*a* is parallel to a surface 42*a* of the LED tip 42. A distance D between the center of the incident face 61*a* and surface 42*a* of the LED tip 42 and a curvature of the incident face 61*a* are designed so that the light emitted from the surface 42*a* of the LED tip 42 at the maximum irradiation angle of 60 degrees is incident to the incident face 61*a* without total reflection in the incident face 61*a* and going around from the incident face 61*a* to the outside.

A face 61*b* at the photosensitive drum 10's side on the light concentrating body 61 is corresponding to an emission face emitting a concentrated static elimination light to the photosensitive drum 10. The emission face 61*b* is formed in a plane face perpendicular to the optical axis A of the LED tip 42. An area of the emission face 61*b* is smaller than a section area of the incident face 61*a* containing upper and lower edge sides (a section area of a face indicated by a reference character C in FIG. 3)

An upper face 61*c* of the light concentrating body 61 is formed in a plane face. A lower face 61*d* of the light concentrating body 61 is formed in a curved shape projecting slightly downward. Thus, the light concentrating body 61 is formed in a roughly fan like shape, which has a small center angle, tapered from the incident face 61*a* to the emission face 61*b*, i.e., from the static eliminating device 14 to the photosensitive drum 10, in a side view.

In the light concentrating body 61, an end part at the incident face 61*a*'s side is interposed between the lower face of the cleaning device 15 and leading part 51*b* of the supporting part 51 and the upper face 61*c* contacts with the lower face of the cleaning device 15. The light concentrating body 61 is supported by the supporting part 51 so that an optical axis OA extending from the center of the incident face 61*a* to the center of the emission face 61*b* coincides with the optical axis A of the LED tip 42. Since the light concentrating body 61 is supported in such a posture, the optical axis OA of the light concentrating body 61 is inclined slightly upward from the static eliminating device 14 to the photosensitive drum 10.

With reference to FIG. 5, the supporting members 65 will be described. FIG. 5 is a bottom view showing the static eliminating device, separating claws, conveyance auxiliary members and light concentrating member.

The supporting member 65 is formed so as to protruded downward at a rear side position in the forward and backward directions of the lower face 61*d* of the light concentrating body 61. A plurality of the supporting members 65 are positioned at predetermined intervals in the left and right directions. Each supporting member 65 has a pair of left and right holders 66L and 66R having the same shape as each other. The left and right holders 66L and 66R are positioned at an interval so as to interpose the separating claw 31 and disk part 35*a* of the conveyance auxiliary member 35 between them in the left and right directions. The left and right holders 66L and 66R may be made of the same material as the light concentrating body 61 and attached to the light concentrating body 61 by screw fastening, welding, adhering or the other. The left and right holders 66L and 66R have upper faces having rectangular shapes elongated in the forward and backward directions in a side view. In the upper faces of the left and right holders 66L and 66R, front gaps 66*a* and rear gaps 66*b* are respectively formed. The front gap 66*a* and rear gap 66*b* are formed in a U-shape in a side view.

In the respective front gaps 66*a* of the left and right holders 66L and 66R, the rotation shafts 31*b* of the separating claw 31 are supported and the separating claw 31 is swingable around the rotation shafts 31*b*. The separating claw 31 is biased by a torsion coil spring (not shown) so that the leading end part 31*a* has a posture of coming into contact with the surface of the photosensitive drum 10 in a counter direction to the rotating direction of the photosensitive drum 10. A biasing force of the torsion coil spring is determined to an extremely small force so that the leading end part 31*a* of the separating claw 31 does not hurt the surface of the photosensitive drum 10.

In the respective rear gaps 66*b* of the left and right holders 66L and 66R, the rotation shafts 35*b* of the conveyance auxiliary member 35 are supported and the conveyance auxiliary member 35 is rotatable around the rotation shafts 35*b*. A lower part from the rotation shafts 35*b* in the disk part 35*a* of the conveyance auxiliary member 35 is protruded downward from the left and right holders 66L and 66R.

Next, actions of the static eliminating device 14, separating claws 31, conveyance auxiliary members 35 and light concentrating member 60 including the above-mentioned configuration will be described.

The recording sheet with the transferred toner is first separated from the surface of the photosensitive drum 10 by the separating claws 31, and then, the conveyance auxiliary members 35 contact with the recording sheet. The conveyance auxiliary members 35 are rotated around the rotation axes 35*b* in accordance with the conveyance of the recording sheet, and simultaneously, presses the recording sheet by the acute top portions of the projected parts 35*c* so as not to float. At this time, since the acute top portions of the projected parts 35*c* contact with the recording sheet at a point, the unfixed toner on the recording sheet is not disturbed.

In the static eliminating device 14, the light emitted by the LED tip 42 is incident and concentrated to the incident face 61*a* of the light concentrating body 61, and then, irradiated to the surface of the photosensitive drum 10 from the emission face 61*b*, thereby eliminating the electrical potential remained on the photosensitive drum 10.

As described above, in the printer 1 according to the embodiment of the present disclosure, in a space between the static eliminating device 14 and photosensitive drum 10 secured as an optical path of the static elimination light, the light concentrating member 60 having a function as the optical path is arranged and the separating claws 31 and the conveyance auxiliary members 35 are supported by this light concentrating member 60. Accordingly, it is possible to exclude a space to be provided for members supporting the separating claws 31 and the conveyance auxiliary members 35 in a printer. Moreover, since the light concentrating member 60 is the thin plate like member, it is possible to attach the light concentrating member 60 to a narrow space as the optical path of the static elimination light. Therefore, if the photosensitive drum 10 is miniaturized, it is possible to arrange the static eliminating device 14, separating claws 31 and the conveyance auxiliary members 35 between the cleaning device 15 and transferring device 18. Further, it is possible to secure a space with a height of the degree of not contacting with the unfixed toner above a toner transferred face of the recording sheet. In accordance with these, it is possible to reduce influence of exposure memory of the photosensitive drum 10 and to save a space of the printer 1.

In the printer 1 of the present disclosure, since the incident face 61*a* of the light concentrating body 61 is formed in the convex lens like shape, the light diffusively emitted from the static eliminating device 14 is concentrated without total reflection in the incident face 61*a* and going around from the incident face 61*a* to the outside. Moreover, since the emission face 61*b* is the plane face and the area of the emission face 61*b* is smaller than the section area of the incident face 61*a* containing the upper and lower edge sides, it is possible to irradiate the photosensitive drum 10 with the concentrated static elimination light by even illumination.

In addition, since the light concentrating body 61 is made of the material having the high transparency with respect to the light of the LED tip 42, it is possible to irradiate the photosensitive drum 10 without attenuating the light amount of the LED tip 42. Therefore, there is no possibility of remarkably reducing static elimination efficiency of the static eliminating device 14, if the light concentrating member 60 is positioned at the optical path of the static elimination light.

Furthermore, since the resin is applied as the material of the light concentrating member 60, it is possible to form the light concentrating member 60 by general and low cost material. Moreover, it is possible to attach the supporting member 65 to the light concentrating body 61 by a simple manner, such as the screw fastening, welding and adhering.

Although, in the embodiment, the static eliminating device 14 configured so that the plurality of the LED tips 42 are arranged was described, in another embodiment, the static eliminating device may be configured by light guide or the like using the LED or the like.

Although, in the embodiment, the printer 1 including both the separating claws 31 and conveyance auxiliary members 35 was described, in another embodiment, the printer may be configured without including conveyance auxiliary members 35.

Although, in the embodiment, the resin was cited as the material of the light concentrating body 61 having high light transparency, in another embodiment, another material, such as a glass, having high light transparency may be applied. Moreover, the supporting member 65 may be made of a different material from the light concentrating body 61.

Although, in the embodiment, a configuration of supporting one separating claw 31 and one conveyance auxiliary member 35 by the supporting member 65 was described, in another embodiment, a plurality of the separating claws 31 and a plurality of the conveyance auxiliary members 35 may be arranged at predetermined intervals on an rotation shaft elongated in the left and right directions. In such a case, the left and right holders 66L and 66R of the supporting member 65 are respectively positioned near left and right ends on the lower face of the light concentrating body 61, the front gaps 66*a* supports the rotation shafts of the separating claws 31 and the rear gaps 66*a* supports the rotation shafts of the conveyance auxiliary members 35.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an image carrier on which an electrostatic latent image is formed;

a development device developing and visualizing the electrostatic latent image by a toner;

a transferring device transferring the toner on the image carrier to a recording sheet;

a static eliminating device irradiating the image carrier with a light to eliminate a remained static charge;

a cleaning device removing the toner remained on the image carrier;

a light concentrating member arranged between the static eliminating device and image carrier to concentrate the light emitted from the static eliminating device and to irradiate the image carrier with the concentrated light;

a separating claw supported by the light concentrating member to separate the recording sheet from the image carrier; and a conveyance auxiliary member supported by the light concentrating member to guide the recording sheet so as to prevent the toner on the recording sheet from contacting with components in the periphery of a conveying path of the recording sheet.

2. The image forming apparatus according to claim 1, wherein the static eliminating device includes a light emitting diode as a light source.

3. An image forming apparatus comprising:

an image carrier on which an electrostatic latent image is formed;

a development device developing and visualizing the electrostatic latent image by a toner;

a transferring device transferring the toner on the image carrier to a recording sheet;

a static eliminating device irradiating the image carrier with a light to eliminate a remained static charge;

a cleaning device removing the toner remained on the image carrier;

a light concentrating member arranged between the static eliminating device and image carrier to concentrate the light emitted from the static eliminating device and to irradiate the image carrier with the concentrated light;

a separating claw supported by the light concentrating member to separate the recording sheet from the image carrier; and a conveyance auxiliary member supported by the light concentrating member to guide the recording sheet so as to prevent the toner on the recording sheet from contacting with components in the periphery of a conveying path of the recording sheet;

wherein the light concentrating member is made of a resin having a high light transparency with respect to the light.

4. An image forming apparatus comprising:

an image carrier on which an electrostatic latent image is formed;

a development device developing and visualizing the electrostatic latent image by a toner;

a transferring device transferring the toner on the image carrier to a recording sheet;

a static eliminating device irradiating the image carrier with a light to eliminate a remained static charge;

a cleaning device removing the toner remained on the image carrier;

a light concentrating member arranged between the static eliminating device and image carrier to concentrate the light emitted from the static eliminating device and to irradiate the image carrier with the concentrated light;

a separating claw supported by the light concentrating member to separate the recording sheet from the image carrier; and a conveyance auxiliary member supported by the light concentrating member to guide the recording sheet so as to prevent the toner on the recording sheet from contacting with components in the periphery of a conveying path of the recording sheet;

wherein the light concentrating member has an incident face and an emission face of the light emitted from the static eliminating device, the incident face is formed in a convex lens like shape toward the static eliminating device in a side view, the emission face is a plane face, and an area of the emission face is smaller than a section area of the incident face containing upper and lower edge sides.

5. An image forming apparatus comprising:

an image carrier on which an electrostatic latent image is formed;

a development device developing and visualizing the electrostatic latent image by a toner;

a transferring device transferring the toner on the image carrier to a recording sheet;

a static eliminating device irradiating the image carrier with a light to eliminate a remained static charge;

a cleaning device removing the toner remained on the image carrier;

a light concentrating member arranged between the static eliminating device and image carrier to concentrate the light emitted from the static eliminating device and to irradiate the image carrier with the concentrated light; and a separating claw supported by the light concentrating member to separate the recording sheet from the image carrier;

wherein the light concentrating member has an incident face and an emission face of the light emitted from the static eliminating device, the incident face is formed in a convex lens like shape toward the static eliminating device in a side view, the emission face is a plane face, and an area of the emission face is smaller than a section area of the incident face containing upper and lower edge sides, and the light concentrating member has an optical axis extending from the center in upward and downward directions of the incident face to the center in the upward and downward directions of the emission face, and the optical axis coincides with an optical axis of the light.

6. An image forming apparatus comprising:

an image carrier on which an electrostatic latent image is formed;

a development device developing and visualizing the electrostatic latent image by a toner;

a transferring device transferring the toner on the image carrier to a recording sheet;

a static eliminating device irradiating the image carrier with a light to eliminate a remained static charge;

a cleaning device removing the toner remained on the image carrier;

a light concentrating member arranged between the static eliminating device and image carrier to concentrate the light emitted from the static eliminating device and to irradiate the image carrier with the concentrated light;

a separating claw supported by the light concentrating member to separate the recording sheet from the image carrier; and a conveyance auxiliary member supported by the light concentrating member to guide the recording sheet so as to prevent the toner on the recording sheet from contacting with components in the periphery of a conveying path of the recording sheet;

wherein the cleaning device has a supporting part supporting the static eliminating device, and the light concentrating member is supported by the supporting part.

7. A light concentrating device arranged between an image carrier, on which a toner image is formed, and a static eliminating device, which eliminates a remained static charge on the image carrier after the toner image is transferred on a recording sheet, comprising:

a light concentrating body concentrating a light emitted from the static eliminating device and irradiating the image carrier with the concentrated light;

a separating claw supported by the light concentrating body to separate the recording sheet from the image carrier; and a conveyance auxiliary member supported by the light concentrating body to guide the recording sheet so as to prevent the toner image from contacting with components in the periphery of a conveying path of the recording sheet.

* * * * *